US005412967A

United States Patent [19]

Ishihara

[11] Patent Number: 5,412,967

[45] Date of Patent: May 9, 1995

[54] METHOD OF MAKING A METALLIC RING-SHAPED BODY

[75] Inventor: Takeshi Ishihara, Tokyo, Japan

[73] Assignee: Ishikawajima-Harima Heavy Industries Co., Ltd., Tokyo, Japan

[21] Appl. No.: 288,879

[22] Filed: Aug. 10, 1994

Related U.S. Application Data

[63] Continuation of Ser. No. 33,325, Mar. 18, 1993, abandoned.

[30] Foreign Application Priority Data

Apr. 6, 1992 [JP] Japan ..... 4-084106
Apr. 6, 1992 [JP] Japan ..... 4-084107

[51] Int. Cl.[6] ..... B21H 1/06
[52] U.S. Cl. ..... 72/70; 72/105
[58] Field of Search ..... 72/68, 70, 105, 106, 72/107, 109, 110, 111; 29/894.354

[56] References Cited

U.S. PATENT DOCUMENTS 3,626,564 12/1971 Daniel .
3,999,416 12/1976 Brooks ..... 72/105
4,016,739 4/1977 Lapin et al. ..... 72/105
4,316,374 2/1982 Nagatsuma ..... 72/105
4,476,194 10/1984 Sanborn et al. .

FOREIGN PATENT DOCUMENTS 124200 12/1971 Czechoslovakia .
2418045 9/1979 France .
181936 7/1989 Japan ..... 72/110
694261 10/1979 U.S.S.R. ..... 72/105

*Primary Examiner*—Lowell A. Larson
*Attorney, Agent, or Firm*—Finnegan, Henderson Farabow, Garrett & Dunner

[57] ABSTRACT

A method for producing a hard metallic ring body is presented in which a stock material of a ring-shape is roll formed between a pair of inner and outer forming rolls, one of which is provided with a shape change section (shaping roll). Roll forming operations are performed in three fabrication stages; initial, intermediate and final fabrication stages. A gap between the inner and the outer rolls is maintained at all times during the three processing stages. Early in the initial fabrication stage, a depression region is formed in the stock material by engaging with the shape change section of the shaping roll, and this engagement is maintained throughout the fabrication stages. The shaping roll and the forming roll are designed so as to cause the stock material to flow in the axial direction by the radial compression forces between the shaping and forming rolls. Severe shape changes can thus be produced accurately and efficiently in the stock material by the cooperative action of the shaping roll and the forming roll. The formed body is mechanically processed and cold rolled as necessary to produce a completed ring body.

20 Claims, 8 Drawing Sheets

METHOD OF MAKING A METALLIC RING-SHAPED BODY

BACKGROUND OF THE INVENTION

This application is a continuation of application Ser. No. 08/033,325 filed Mar. 18, 1993, now abandoned.

FIELD OF THE INVENTION

This invention relates to a method of making a metallic ring body having surface shapes on either the inner or the outer peripheral surface of the ring body, and in particular to fabricating the surface shapes by roll forming.

TECHNICAL BACKGROUND

A method of making metallic rings for use in gas turbine engines is disclosed in a Japanese patent application Sho 62-2889. The method discloses, in part:

1. Cold rolling of a nickel or cobalt based metallic ring body with the use of a plurality of rolls.
2. Initial forming steps are aimed primarily to elongate the ring body in the axial direction.
3. The subsequent forming steps are needed to increase the ring diameter with the use of several pairs of rolls.
4. As illustrated conceptually in FIGS. 4 and 5, the disclosed method is designed to perform roll forming while enclosing the cross section of the work piece completely within the forming rolls.

The features of such a method are said to be:

1. Achievement of tight limits on manufacturing tolerances within ±0.002 inches without having to resort to later machining and hot rolling steps; and
2. Efficient shaping in the axial direction of the cross sectional shape is achieved early in the forming process in the initial hot working phase of fabrication.

However, when such a method is examined closely for application to, for example, AMS5754 alloy (SAE, Society for Automotive Engineers, alloy designation) for making metallic rings of the required tight tolerances for gas turbine engines, it is realized that such a process requires over seventeen pairs of forming rolls, with the attendant problems of high cost of manufacturing the rolls, high effort expended in changing the rolls, lengthening of cold roll processing and high cost of manufacturing small lots of different shapes. Therefore, improvements in such aspects of manufacturing are needed before the above method becomes industrially useful.

SUMMARY OF THE INVENTION

The present invention of fabricating surface shapes on an inner or an outer ring surface of a ring body is concerned with achieving the following objectives:

(a) to produce severe shape changes on an inner or outer ring surface cost effectively;

(b) to reduce the quantity of forming rolls required significantly to about three pairs so as to produce savings in the manufacturing and handling costs for the forming rolls; and (c) to improve the quality of the ring body.

According to the present invention, a method is presented for fabricating surface shapes on either the inner surface or the outer peripheral surface of a metallic ring body. In the following description of the process, the axial direction is the direction of the ring axis and the radial direction is the direction in the radius/diameter direction of the ring body, and a peripheral surface refers either to an inner or an outer peripheral surface of the ring body.

The method of fabricating surface shapes on a peripheral surface of the ring body by roll forming comprises the steps of:

(a) preparing a metallic stock material of a ring-shape (henceforth referred to as the stock material), having an inner diameter which is not larger than an inner diameter of a completed ring body, and whose cross sectional area in the axial direction is not less than a cross sectional area of the completed ring body;

(b) placing the stock material between a pair of rolls consisting of a shaping roll and a forming roll;

(c) forming a locally thinned ring-shaped depressed region (RSDR) depressed in the radial direction with the shaping roll on a peripheral surface of the stock material;

(d) performing roll forming of the stock material while maintaining a separation between the shaping roll and the forming roll;

(e) applying a radial compressive force to the RSDR so as to increase the axial dimension of the stock material.

The fabrication process further includes at least one of the following processing steps:

(1) continue to roll form until the dimension of one of the inner diameter, outer diameter or the axial dimension reaches a predetermined value;

(2) machine to final dimensions after the completion of roll forming the stock material;

(3) roll form the surface shapes on the peripheral surface with the shaping roll while controlling the deformation at the peripheral surface in contact with the forming roll;

(4) divide the ring body at a plane perpendicular to the axis after the completion of roll forming of the stock material;

(5) form the initial RSDR in the central axial region of the stock material;

(6) form the surface shapes so as to be symmetrical about a plane perpendicular to the axis;

(7) form the initial RSDR while restraining the transfer of mass of the stock material in the axial direction;

(8) control the drifting of the stock material in the axial direction by engaging a protrusion section of the shaping roll with the initial RSDR on the stock material.

(9) after the completion of an intermediate fabrication stage, roll form shapes while permitting the surface being formed to move freely in the axial direction;

(10) form shapes on a peripheral surface of the stock material while restraining the drifting of the stock material by firmly holding the stock material between the surface being formed and the corresponding shaping roll;

(11) form a tapered surface on the stock material such that the diameter toward the axial end is larger than the diameter at the central region of the ring body on a peripheral surface of the stock material;

(12) form a tapered surface on the stock material such that the diameter toward the axial end is smaller than the diameter at the central region of the ring body on a peripheral surface of the stock material;

(13) perform compression roll forming by cold rolling;

(14) after the completion of the intermediate fabrication stage, a shaping roll is shared between the intermediate and final fabrication stages;

(15) form the ring body using materials suitable for use in gas turbine engines;

(16) perform intermediate annealing in between the roll forming operations;

(17) form a shape change region in the vicinity of the axial ends of the stock material;

(18) form a shape change region in the vicinity of the initial RSDR;

(19) inspect the dimension of the diameter of the ring body stock, which refer to in-process ring bodies intermediate between the stock material and the completed ring body, during the final forming stages.

1. According to the present invention of fabricating surface shapes on a peripheral surface of the stock material, the following advantages accrue.
   (1) By maintaining a spacing between the inner and outer rolls while roll forming, the axial mass transfer, which is caused by the transfer of the stock material in the axial direction in response to the radial compression of the stock material, is made relatively easier.
   (2) By providing, early in the fabrication stage, a locally thinned ring-shaped depressed region (RSDR) on a peripheral surface of the stock material, the stock material can be transferred suitably in both axial directions so as to enable the subsequent fabrication to be conducted relatively easily.
   (3) By taking such measures, the quantity of forming rolls required is reduced, enabling to lower the labor effort and the cost of manufacturing the ring body.

According to the method presented above, because the roll forming process is controlled by one parameter, i.e. one of the inner diameter, the outer diameter and the axial dimension, the process prevents a generation of rejects caused by off-tolerance of one critical parameter, as well as improving the subsequent fabrication efficiency.

2. Further,
   (1) by providing a finish machining step, such as grinding of the ring body, any off-tolerance ring bodies can be made into a ring body of high precision, and
   (2) by combining roll forming with machining, the advantages of each of the processing techniques can be utilized to enable production of the ring body more quickly compared with the conventional forming methods.
3. Further,
   (1) by restricting the severe shape forming to one specific peripheral surface while limiting the degree of deformation of the surface which is not being shaped severely, the flow of the stock material in the region being severely deformed is promoted, thereby facilitating the shaping operation on the specific surface; and
   (2) limiting the degree of deformation on the peripheral surfaces facilitates management of the progress of the roll forming operation.
4. Further, by parting the formed ring body at a plane perpendicular to the axial of the ring body into two portions, it is possible to obtain two ring bodies readily, thereby enabling to increase the manufacturing productivity.
5. Further, by forming the initial RSDR in the central axial region of the stock material, it is possible:
   (1) to prevent the axial shift of the stock material, i.e. drifting of the stock material being roll formed in the axial direction, and
   (2) to distribute the stock material in the axial direction equally in the subsequent forming operations.
6. Further, because the stock material is symmetric in the axial direction, it is possible:
   (1) to form two ring bodies in one forming operation or to form a ring body which exhibits an axial symmetry, and
   (2) to distribute the stock material from the central RSDR equally in the axial direction, thereby enabling to form the shapes smoothly.
7. Further, by forming the initial RSDR on the stock material while restraining the axial shift of the stock material, it becomes possible to correctly position and accurately form the initial RSDR in the specified position in the axial direction of the stock material, thereby permitting the subsequent forming steps to be carried out with precision, using the RSDR as the reference base.
8. Further,
   (1) by engaging the initial RSDR on the stock material with the tip section of the shaping roll to restrain the axial shift of the initial RSDR, it is possible to continue to maintain the degree of dimensional precision of the initial RSDR in the subsequent forming operations, and
   (2) by preventing the axial shift of the shaped surface, the formability of the opposite surface (non-shaping surface) is improved, and the specified shape can be achieved easily.
9. Further,
   (1) when the shaping performed while permitting the stock material to move freely in the axial direction, the flow of the stock material caused by the radial compression of the stock material can take place smoothly in the vicinity of the shaped surface, leading to an efficient shaping operation, and
   (2) accordingly, it is possible to produce a ring body having a large shape variation in the axial direction.
10. Further, by restraining the axial shift of the stock material by contacting the shaped surface of the stock material with a respective shaping roll, it is possible to provide precision shapes in the correct regions of the ring body.
11. Further,
   (1) when the axial end diameters of the tapered region on the ring body are made large, the engagement of the tapered surfaces with the respective shaping rolls prevents the axial shift of the stock material, thereby improving the forming precision in the opposite surfaces of the ring body, and
   (2) by following such a method, the radial flow of the stock material is facilitated, thus improving the formability of the shaped surface.
12. Further,
   (1) when the axial end diameters of the tapered region are made small, the engagement of the tapered surfaces with the respective shaping rolls prevents the axial shift of the stock material, thereby improving the forming precision in the opposite surfaces of the ring body, and (2) by following such a method, the radial flow of the stock material in the vicinity of the axial central region of the stock material is facilitated, thus improving the formability of the shaped surface in the vicinity of the central region of the stock material.

13. Further, by conducting the roll forming operation by cold rolling, it is possible to minimize microstructural transformations of the metallic material, thereby enabling to achieve improved uniformity of the ring body.

14. Further, by sharing one common roll in roll forming after the intermediate fabrication stage, it becomes possible to decrease the quantity of shaping rolls required for forming a shaped surface.

15. Further, (1) the method of forming the shaped surface presented above enables the shape forming technique to be applied to hard materials such as those used for making gas turbine engines, and (2) thus enabling to widen the scope of applicability of the manufacturing method.

16. Further, by providing intermediate annealing steps, hardening which may take place due to cold rolling can be controlled, thereby improving the subsequent formability.

17. Further, it is possible to improve the formability of the stock material by enlarging the RSDR, thereby facilitating the material flow in the axial end direction thereof.

18. Further, because a mass transfer of the stock material occurs to the axial ends of the RSDR during the formation of the RSDR on the stock material, the formability of the stock material in the vicinity of the RSDR is improved.

19. Further, by controlling the forming process by means of diameter checking of the ring body stock, the generation of excess material regions is controlled, thereby improving the operational efficiency of the final fabrication stage.

BRIEF DESCRIPTION OF THE DRAWINGS

In the drawings presented herein, a ring body stands vertically with the ring axis lying horizontally in the plane of the paper, and the drawings show only one side of the cross section made through the ring axis, viewed in the direction of the diameter of the ring body. In the drawings of the forming rolls, the outer roll is shown on the top, and the inner roll is shown at the bottom, unless otherwise shown.

PREFERRED EMBODIMENTS OF THE INVENTION

First Embodiment

Figure 1:
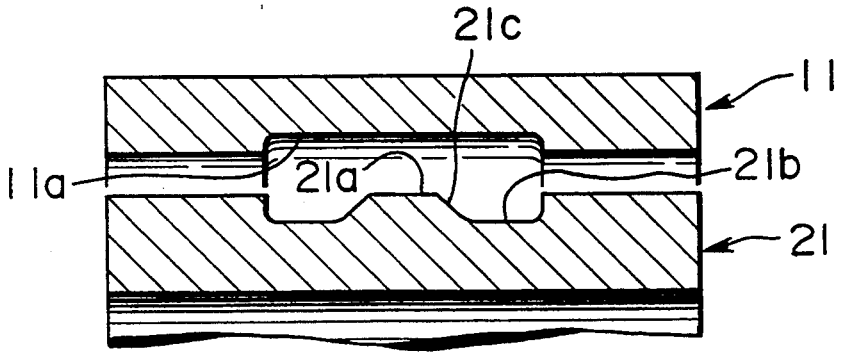
FIG. 1 shows a front cross sectional view of the forming rolls used in a first embodiment of the method of forming shapes on an inner peripheral surface of a ring body.

A first embodiment concerning a method of making surface shapes on an inner peripheral surface of a ring body will be explained with reference to FIG. 1 to 4.

A metallic stock material 1, having the dimensions of 242 mm inner diameter, 14 mm wall thickness and 46 mm width, and having a rectangular cross sectional shape, shown in FIG. 4(*a*), was made of AM 5754 steel mentioned above.

The stock material 1 had a smaller inner diameter and a larger axial cross sectional area compared with either the final ring body stock 4 shown by the solid line in FIG. 4(*f*), or the completed ring body 5 shown by the dotted line in FIG. 4(*f*). In the following, the parts on the forming rolls are referred to as "sections" while the parts on the stock material are referred to as "regions" to avoid confusing between similarly shaped sections of the forming rolls and the mating ring body. The completed ring body 5 is produced from stock material 1 through various stages of rolling the ring body stock, 2, 3, 4 into the final product as a metallic ring-shaped body or simply ring body.

Outline of the Fabrication Process

A metallic ring body (either the final ring body stock 4 or the completed ring body 5) having surface shapes on the inner peripheral surface is made by a four-stage fabrication process: initial, intermediate and final roll forming fabrication stages, and the machine fabrication stage. The initial fabrication stage consists of compression rolling of the stock material 1 between a pair of initial stage forming rolls consisting of an outer roughing-roll 11 and an inner rough shaping-roll 21, shown in FIG. 1, to produce an initial roll formed ring body stock 2 (shortened to initial body 2). The intermediate fabrication stage consists of compression roll forming of the initial ring body stock 2 between a pair of intermediate stage forming rolls consisting of an outer intermediate forming roll 12 and an inner intermediate shaping roll 22, shown in FIG. 2, to produce an intermediate rolled ring body stock 3. The final fabrication stage consists of compression roll forming the intermediate rolled ring body stock 3 between a pair of an outer finishing roll 13 and an inner finish shaping roll 23, shown in FIG. 3, to produce a final ring body stock 4. The final ring body stock 4 is finish machined to remove excess materials to produce a completed ring body 5. The various steps in the three fabrication stages are illustrated in FIGS. 4(*a*) to (*f*).

The various steps of roll forming are performed by cold rolling to prevent phase transformations of the hard stock material, such as AM 5754, and various annealing steps are involved to soften the material to improve the subsequent fabrication steps.

In the following embodiments, the forming rolls to produce shapes are termed shaping rolls and, in the first embodiment, an inner roll is used to produce shapes on the inner peripheral surface of the ring body illustrated in FIGS. 1 to 3. Therefore, the inner roll is the shaping roll in this case. The outer roll in this case produces a lesser degree of deformation in the stock material, and is termed a forming roll.

The outer forming roll 11 (top) is provided with a retaining depression 11*a*, as shown in FIG. 1, of a cylindrical shape extending around the inner peripheral surface of the roll parallel to the ring axis, so as to be in a plane contact and hold the outer peripheral surface of the stock material during the initial fabrication stage.

Figure 2:
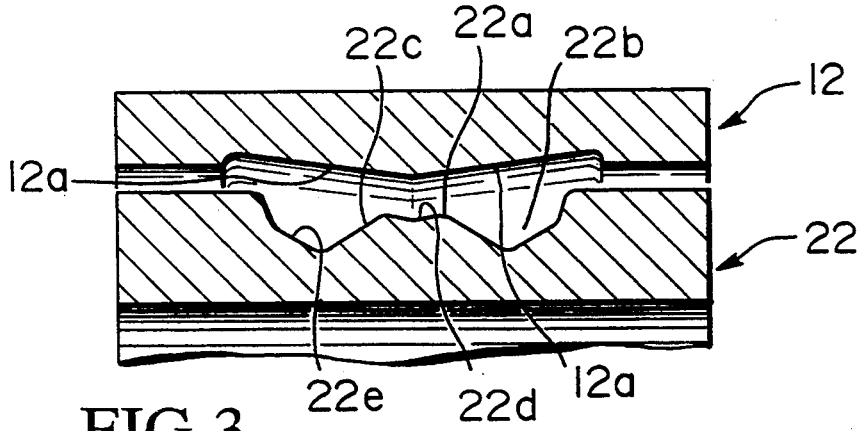
FIG. 2 shows a front cross sectional view of the forming rolls used in the intermediate fabrication stage of the first embodiment.

The outer intermediate roll 12, in FIG. 2, is provided with a protruding taper forming section 12*a*, formed symmetrically about the ring axis, and whose central section is protruding in the radial direction (shown protruding downward in FIG. 2).

Figure 3:
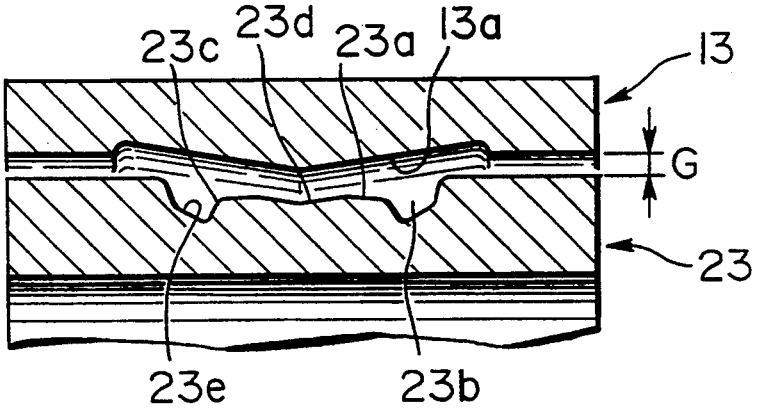
FIG. 3 shows a front cross sectional view of the forming rolls used in the final fabrication stage of the first embodiment.
Figure 4A:
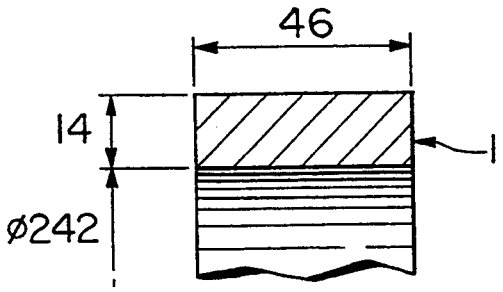
FIGS. 4(*a*) to 4(*f*) presents front cross sectional views of a stock material being processed through various stages of fabrication with the use of the forming rolls shown in FIGS. 1 to 3 to produce various shapes of ring bodies.
Figure 4D:
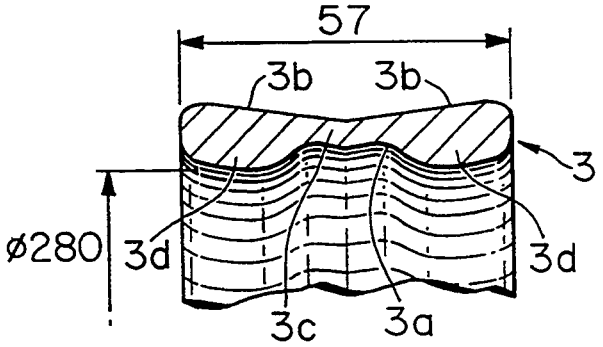
Figure 4B:
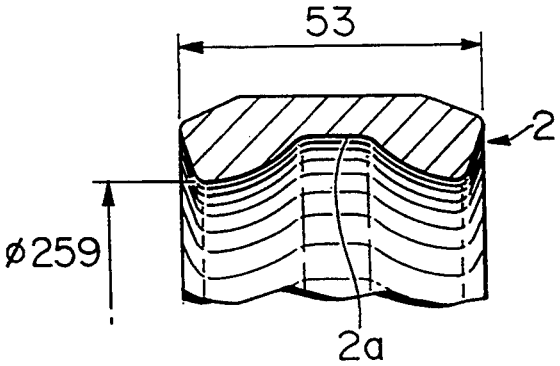
Figure 4E:
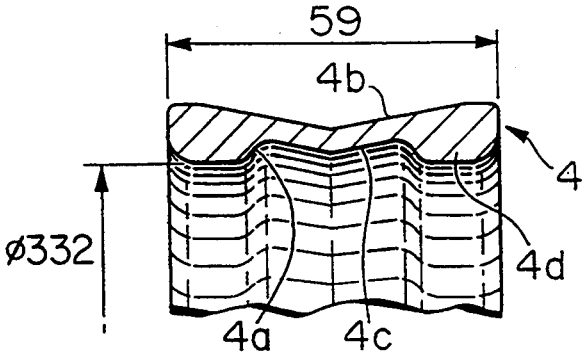
Figure 4C:
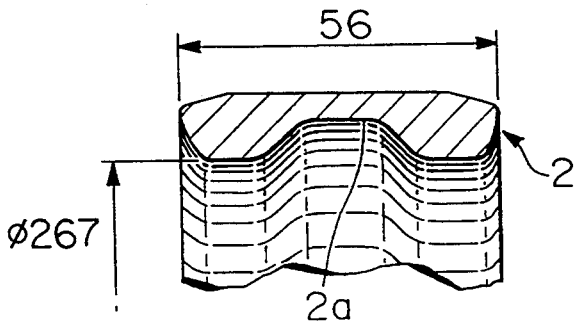
Figure 4F:
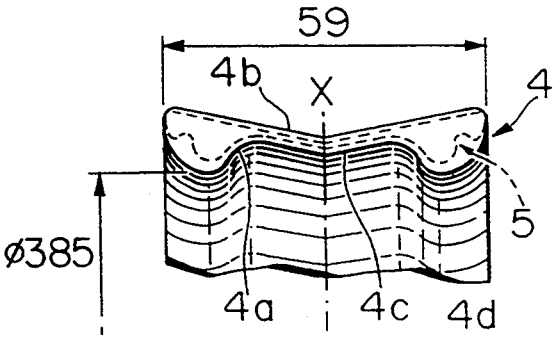
Figure 5:
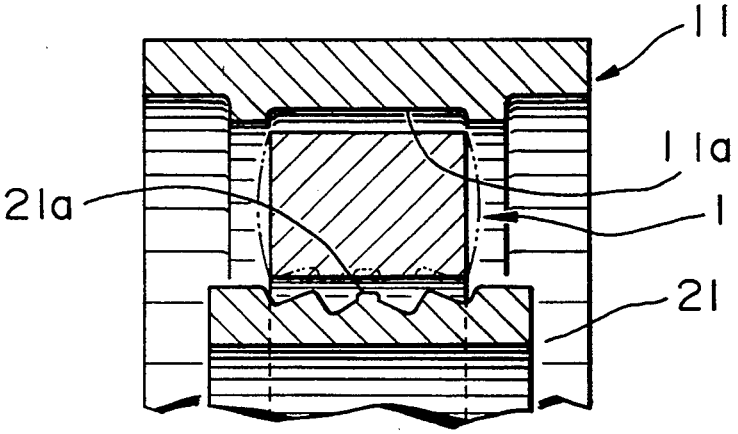
FIG. 5 shows a front cross sectional view of a second embodiment of making surface shapes on an inner peripheral surface of a ring body by means of an outer forming roll and an inner shaping roll during the initial fabrication stage of a second embodiment.
Figure 6:
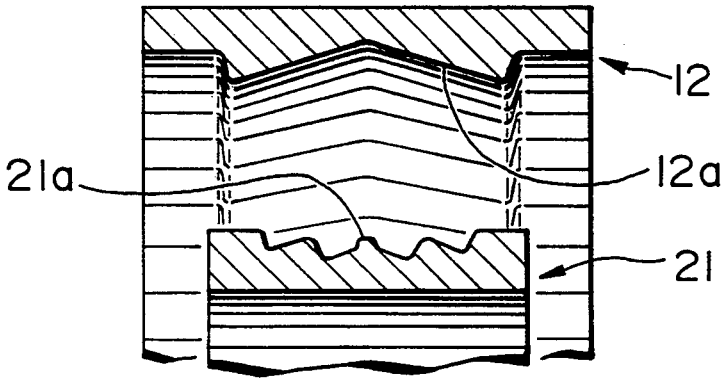
FIG. 6 shows a cross sectional view of the forming rolls used in the intermediate fabrication stage of the second embodiment.
Figure 7:
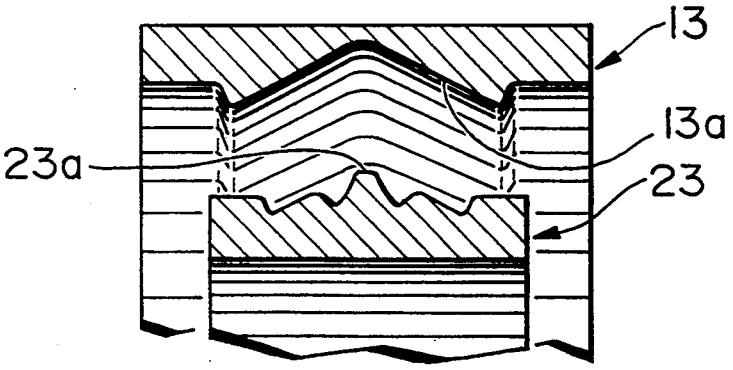
FIG. 7 shows a cross sectional view of the forming rolls used in the final fabrication stage of the second embodiment.

The outer finishing roll 13 is also provided with a taper forming section 13*a*, as shown in FIG. 3, having the same profile shape as that for the outer intermediate roll 12. The profile shape is arranged so that some rolls can be interchanged between the intermediate and final stages of fabrication.

The inner rough shaping roll 21 for the initial fabrication stage is provided, as shown in FIG. 1, with a ring-shaped protrusion section (RSPS) 21*a* and the forming channels 21*b* on both sides of the protrusion section 21*a*, and a sloped section 21*c* disposed around the RSPS 21*a* merging the RSPS 21*a* with the forming channels 21*b*. The RSPS 21*a* is shaped cylindrically, and is provided with a cylindrical side surface which extends parallel to the axial direction.

The inner intermediate shaping roll 22 is also provided, as shown in FIG. 2, with an axially centrally disposed ring-shaped protrusion section RSPS 22*a*, the forming cavities 22*b* and the sloped section 22*c*. In the center of the RSPS 22*a* is a slightly depressed small depression section 22*d*, and the retaining section 22*b* is provided with an inner forming section 22*e*.

The sloped section 22*c* is shaped so that the slope of the surface is the same as that shown in FIG. 1, but the sloped length is longer than that shown in FIG. 1 so as to make deeper forming channels.

The inner finish shaping roll 23 is provided, as shown in FIG. 3, with a protrusion RSPS 23*a*, which extends wider axially compared with that shown in FIG. 2, and surrounded by a retaining section 23*b* defined by the inner shaping section 23*e*, which is shorter than that shown in FIG. 2. The finish shaping roll 23 also has a sloped section 23*c* surrounding the protrusion 23*a*, and a small depression 23*d*, having a gently sloped surface, and disposed in the center of the protrusion RSPS 23*a*.

Initial Roll Forming Fabrication Stage

In the initial fabrication stage, a stock material 1 having a cross sectional shape of dimensions shown in FIG. 4(*a*) is placed as shown in FIG. 1 between the outer-roughing roll 11 and the inner rough shaping roll 21, and is processed through the steps shown in FIGS. 4(*b*) to (*c*) to produce the various shapes and sizes of the ring bodies shown in FIGS. 4(*b*) to (*c*).

For example, roll forming steps are repeated from fifty to five hundred times, preferably around three hundred times, to produce an initial ring body stock 2 of a shape shown in FIG. 4(*c*).

By increasing the contact pressure, between the inner peripheral surface of the stock material 1 and the RSPS 21*a* of the inner rough shaping roll 21, while engaging the outer peripheral surface of the stock material 1 in the retaining depression 11*a* of the outer roughing roll 11, the initial RSDR 2*a* shown in FIG. 4(*b*) is produced in the stock material 1.

In this roll forming step, because the outer peripheral surface of the stock material 1 is rigidly held in contact with the inner surface of the retaining depression 11*a* of the outer roughing roll 11, the stock material 1 is not able to shift its position in the axial direction, thus enabling to form the initial depression region 2*a* in the stock material 1 corresponding to the initial depression section 21*a* of the inner rough shaping roll 21 accurately in the center region of the inner peripheral surface of the stock material 1.

As the initial stage roll forming of the retaining depression region 2*a* progresses, the central region of the stock material 1 subjected to a high contact pressure is plastically spread out, and because the contact surface between the stock material 1 and the retaining depression 11*a* is planar and parallel to the axial direction, the compressed material flows so that the stock material 1 becomes distributed primarily to increase the wall thickness on the inner peripheral surface of the stock material 1, i.e. away from the regions in contact with the RSPS 21*a* of the inner rough shaping roll 21.

Because a gap is provided between the forming rolls 11 and 21, the extension of the stock material 1 in the axial direction can takes place, allowing the stock material to extend in the axial dimension. Initial fabrication thus increases the inner diameter of the stock material 1 while leading to a decrease in the effective axial cross sectional area of the stock material.

As described above, as the forming operation of the initial depression section 2*a* of the inner peripheral surface of the initial ring body stock 2 is continued, the stock material becomes distributed equally in the axial direction, and also, the initial ring body stock 2 begins to take a curved shape, and in the process a cylindrical surface becomes formed on the outer peripheral surface of the ring body stock 2. Thus, during the initial stage, a flow of metallic material takes place to both axial directions of the initial depression section 2*a*, as illustrated in FIG. 4(*b*).

Intermediate Roll Forming Fabrication Stage

The intermediate fabrication stage is performed by placing the initial ring body stock 2 between the outer intermediate roll 12 and the inner intermediate shaping roll 22, as shown in FIG. 2.

In the intermediate fabrication stage also, roll forming steps are repeated from fifty to five hundred times, preferably around three hundred times, for example, to produce an intermediate ring body stock 3 of a shape shown in FIG. 4(*d*).

As the roll forming process is continued in the intermediate fabrication stage while engaging the protrusion section RSPS 22*a* of the inner intermediate shaping roll 22 in the initial RSDR 2*a* of the initial ring body stock 2, the positional alignment of the ring body stock 2 is achieved when the initial ring body stock 2 is deformed such that the region of the stock material in contact with protrusion section RSPS 22*a* becomes merged the region of the stock material in contact with the sloped section 22*c*.

During this stage of roll forming, a region of the inner peripheral surface of the ring body stock 2 comes into contact with the inner forming section 22*e*, and enlarging of the contact region occurs, between the ring body stock 2 and the taper forming surface 12*a* of the outer intermediate roll 12, and these two factors lead to the formation of the curved profile shape of the intermediate ring body stock 3 shown in FIG. 4(*d*).

Roll forming is continued further by engaging the ring-shaped depression region RSDR 3*a* of the ring body stock 3 with the protrusion section RSPS 22*a* and the sloped section 22*c* of the inner intermediate shaping roll 22, thereby retaining the ring body stock 3 in place, and preventing the axial shift of the ring body stock 3. Therefore, even for the case of deforming the outer peripheral surface of the ring body stock 3 in contact with the taper forming surface 12*a* of the outer shaping roll 12 to produce the outer tapered section 3*b*, the retaining effect is operative to prevent the axial shift of the ring body stock 3, thereby enabling redistribution of the stock material in the axial direction to take place smoothly and uniformly.

During the intermediate fabrication stage, the degree of deformation associated with the roll forming of the outer peripheral surface is relatively mild (which refers to the formation of outer tapered surface 3*b* by the taper forming section 12*a*). However, there is a high degree of deformation accompanying roll forming of the inner peripheral surface of the intermediate ring body stock 3, involving the RSPS 22*a*, shaping channel 22*b*, sloped section 22*c*, small depression section 22*d* and inner forming section 22*e* by the shaping action of the inner shaping roll 22.

Accordingly, as the ring body stock 3 is being formed during this intermediate fabrication stage, the stock material becomes redistributed progressively from the central region to the axial extremities of the ring body stock 3 thus forming the central thin section 3*c* surrounded by the thick sections 3*d* (shaped sections) of the intermediate ring body stock 3.

Final Roll Forming Fabrication Stage

Final fabrication stage is carried out by placing the intermediate ring body stock 3 between the outer finishing roll 13 and the inner finish shaping roll 23.

In the final fabrication stage also, roll forming steps are repeated from fifty to five hundred times, preferably around three hundred times, for example, to produce a final ring body stock 4 of a shape shown in FIG. 4(*f*).

The positional alignment is carried out by placing the taper forming surface 13*a* of the outer finishing roll 13 in contact with the outer tapered regions 3*b* of the intermediate ring body stock 3.

Further, the final ring body stock 4 shown in FIGS. 4(*e*) and (*f*) is fabricated by engaging the protrusion RSPS 23*a* of the inner finish shaping roll 23 with the small depression region 3*a* of the intermediate ring body stock 3.

In the final fabrication stage, the deformation of the stock material is primarily concentrated on the inner peripheral surface, because the taper forming section 12*a*, 13*a* of the outer rolls 12 and 13, shown in FIGS. 2 and 3, have the same size and shape, and consequently there is little deformations taking place there.

The shaping of the final ring body stock 4 in the final fabrication stage is continued until the specified sizes and shapes, shown in FIG. 4(*f*), are obtained, but the gap G between the inner finish shaping roll 23 and the outer finishing roll 13 is maintained, as shown in FIG. 3, so that the material flow accompanying the thinning of the thin central section 4*c* takes place in the axial direction.

It is an effective control technique to measure the dimensions of the various sections of the final ring body stock 4 (especially the inner radius) as necessary during the final fabrication stage, and to stop the process when the specified dimension is achieved. More specifically, the dimensions of the various parts of the fabricated final ring body stock 4 are controlled, being aware that the next step will be machining to remove material, so that the dimension of one of the following is close to the final dimension, i.e. the inner radius to be slightly smaller; the outer radius to be slightly larger; and the axial dimension to be slightly larger than that of the final ring body stock 4.

By using the outer forming rolls 12 and 13 in both the intermediate and finish stages of the roll forming operation, there is very little new deformation of the outer peripheral surface of the final ring body stock 4. Therefore, the material flow accompanying the deformation in the radial direction of the final RSDR 4*a* occurs smoothly, leading to produce the shape changes in the tapered surface 4*b* on the outer peripheral surface, thin section 4*c* in the central region, and the surface shape change section 4*d* at both ends in the radial direction of the inner peripheral surface.

Machine Fabrication Stage

The final ring body stock 4 is rolled formed to the shape shown by the solid line in FIG. 4(*f*) as described above, leaving the excess material to be machined off as shown by the dotted line.

When the excess material shown in FIG. 4(*f*) is removed, the completed ring body 5 is produced.

Two completed ring body 5 of identical shape and sizes are produced by either parting at the line X-Y and machining to size, or by grinding first and parting next.

In general, the ring body sizes are chosen so as to minimize the excess material to be machined off, however, to increase machining precision and/or production efficiency the material removed may range from 30–60% and preferably around 40%.

In summary, the material flow and redistribution brought about by the series of forming operations to produce two parts of identical shape and dimension by machining operations, shown by FIGS. 4(*a*) to (*f*) are critically affected by the precise positioning of the initial ring-shaped depression section 2*a* during the initial fabrication stage in the correct central position in the axial direction.

Second Embodiment

FIGS. 5 to 8 show a second embodiment of forming shapes on the inner peripheral surface of a ring body. The shaping roll is again the inner forming roll.

Figure 8:
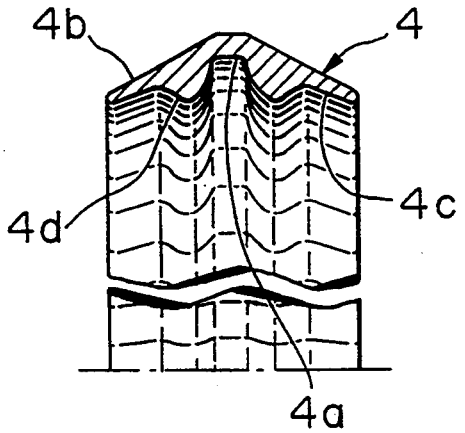
FIG. 8 shows a cross sectional view of the ring body after the final fabrication stage shown in FIG. 7.

In the forming process of this embodiment, various forming rolls shown in FIGS. 5 to 8 are employed to produce the finished ring body stock 4 shown in FIG. 8. They are an outer roughing roll 11 and an inner rough shaping roll 21 shown in FIG. 5, outer intermediate forming roll 12 and inner rough shaping roll 21 shown in FIG. 6, and an outer finishing roll 13 and inner finish shaping roll 23 shown in FIG. 7. In the intermediate fabrication stage, the inner rough shaping roll 21 is shared in forming the various intermediate shapes.

In this embodiment also, in accordance with the steps illustrated in FIGS. 1 to 4, a gap G between the inner roll and the outer roll is maintained during the forming steps using the forming rolls shown in FIGS. 5 to 8 so as to permit easy flow of the stock material in the axial direction of the ring body.

In the second embodiment, the gap G operates effectively to provide the material flow in the initial forming stage by engaging the outer peripheral surface of the stock material 1 with the retaining depression 11*a* thus controlling the material flow in the axial direction at the outer peripheral surface of the stock material 1; and in the intermediate fabrication stage, because the inner rough shaping roll 21 is shared between the initial and the intermediate stages, the RSPS 21*a* of the inner rough shaping roll 21 is engaged with the inner peripheral surface of the stock material 1, thereby preventing the axial flow of the stock material as well as the shifting of the axis during the intermediate forming operation. The ring body is subjected to the final fabrication process to produced a completed ring body 5.

The roll forming method of the present invention can be applied to manufacturing of other ring-shaped bodies of the following shapes.

(1) A ring-shaped metal body having a tapered surface on the outer ring surface so that an axial end diameter is larger than that in the central region of the ring body, and having shape change regions of a large wall thickness in a central axial region of the ring body.

(2) A ring-shaped metal body having a tapered surface on the outer ring surface so that the axial end diameter is smaller than that in the central region of the ring body, and having shape change regions of a large wall thickness in an axial end region of the ring body.

(3) A ring-shaped metal body as in (1) or (2) above, and having a shape change region at an axial end or in a axial central region of the inner peripheral surface.

(4) A ring-shaped metal ring body having a cylindrical outer peripheral surface region formed therein.

Third Embodiment

A third embodiment is concerned with an application of the fabrication method of the present invention to a ring body having a shape change region on the outer peripheral surface. The shapes are produced by pressing the outer peripheral surface of a stock material against the inner surface of an outer forming roll, therefore, the outer forming roll becomes the shaping roll in the third embodiment. The embodiment will be explained with reference to FIGS. 9–15.

Figure 9:
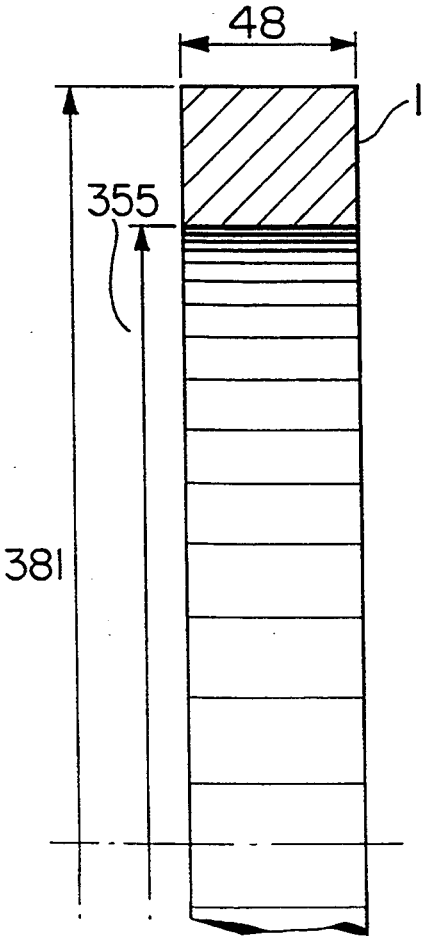
FIG. 9 shows the dimensions of a stock material used in a third embodiment.

A metallic stock material 1 shown in FIG. 9 is made of a material such as AM 5754, for example, and has a rectangular cross sectional shape with an outer diameter 381 mm, an inner diameter 355 mm and a width of 48 mm.

Figure 14:
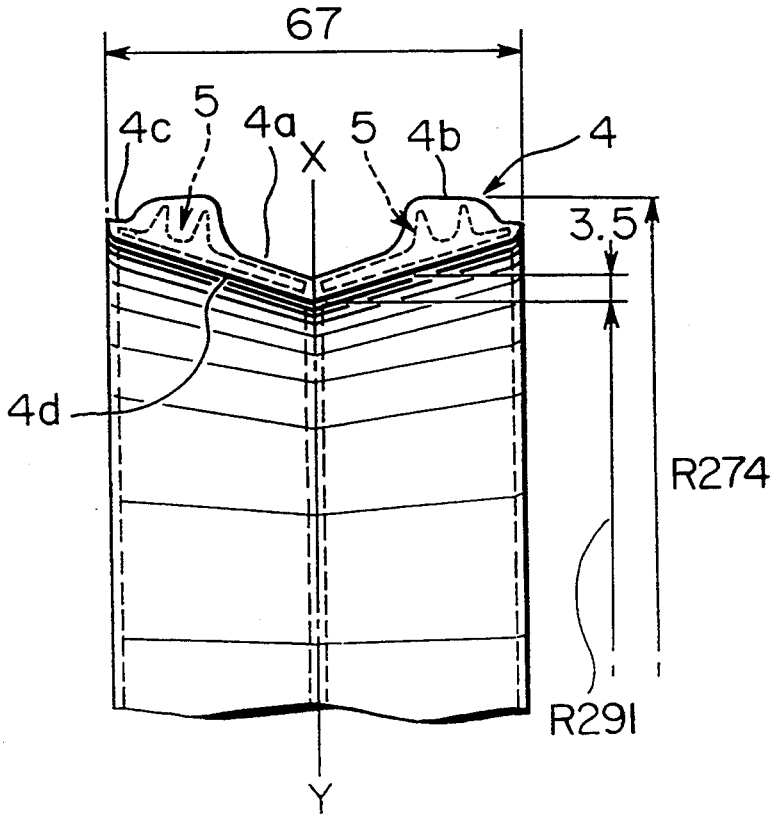
FIG. 14 shows a cross sectional view of the ring body after the final fabrication stage (solid line) shown in FIG. 13, and the completed ring body (dotted line).
Figure 15A:
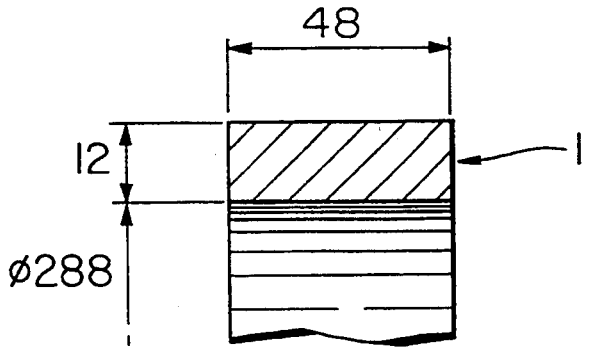
FIGS. 15(*a*) to (*g*) present cross sectional views of the stock material being processed through various stages of fabrication in a fourth embodiment.
Figure 15B:
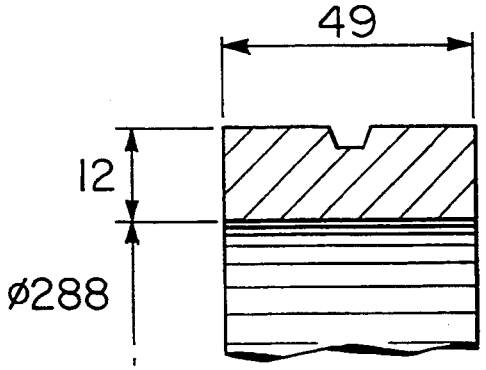
Figure 15C:
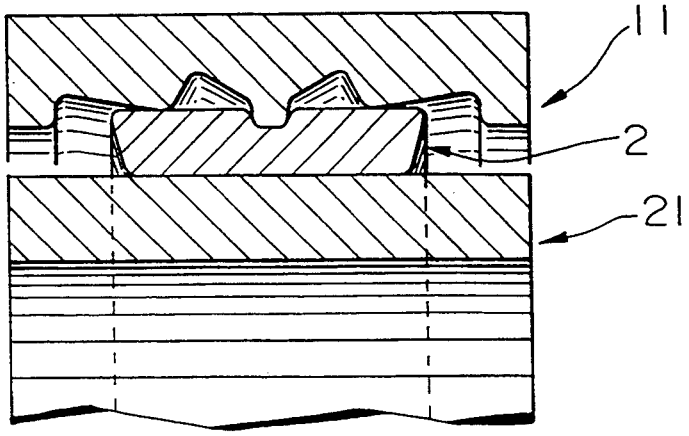
Figure 15D:
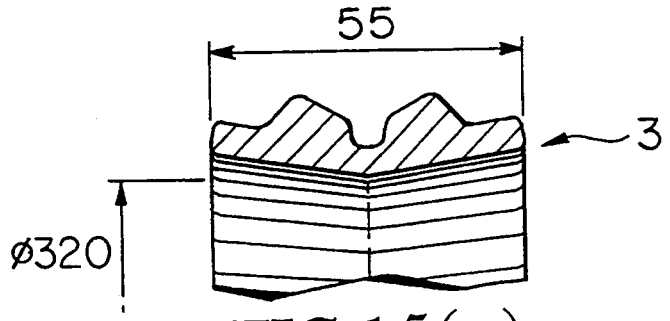
Figure 15E:
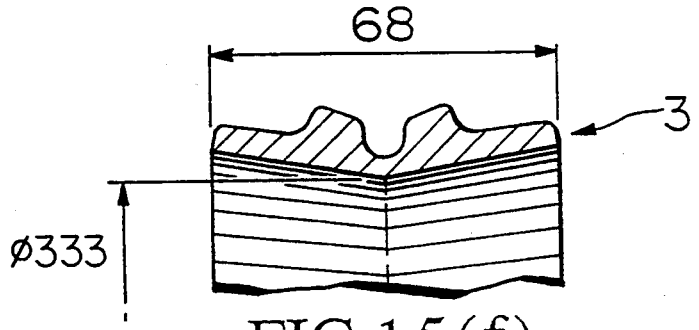
Figure 15F:
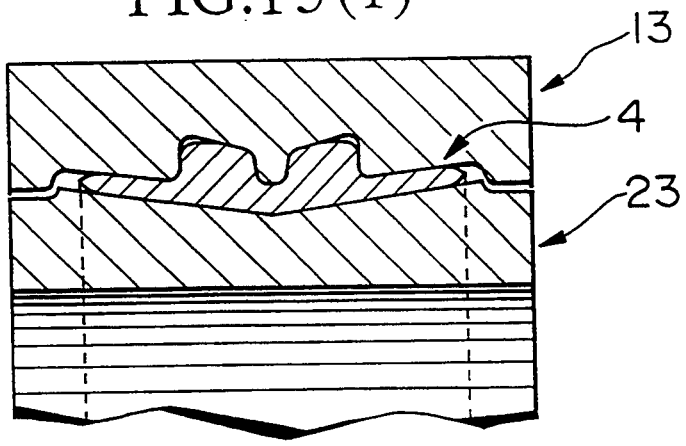
Figure 15G:
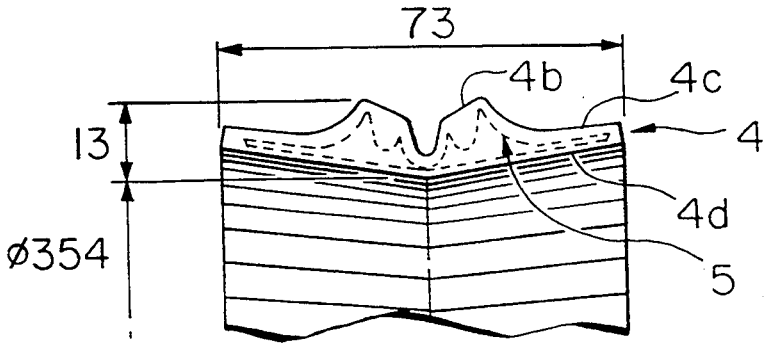

The starting metallic material 1 is shaped larger than both the final ring body stock 4 and the completed ring body 5, illustrated in FIG. 14 by solid and dotted lines.

The essential steps in the fabrication processing are roughly the same as in the first and second embodiments.

The shapes which can be formed by the method of the third embodiment are described below.

To produce a ring-shaped metallic ring body having a shape change region on the outer peripheral surface, three pairs of forming rolls, shown for example in FIGS. 10 to 14, are used.

Figure 10:
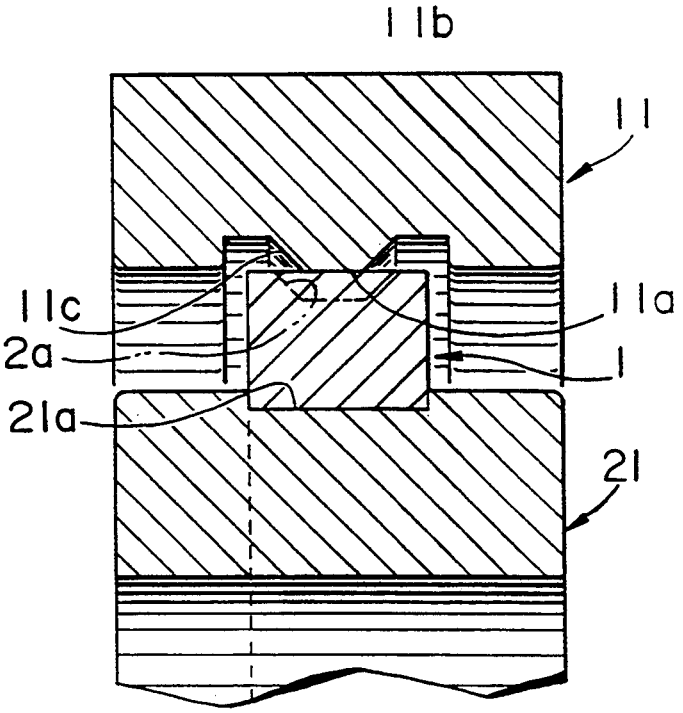
FIG. 10 shows a cross sectional views of the forming rolls used in the initial fabrication stage to fabricate shapes on an outer peripheral surface of a ring body in the third embodiment with an outer roll and an inner roll.

As shown in FIG. 10, the outer roughing roll is now a shaping roll, and is termed an outer rough shaping roll 11, and it comprises: a RSPS 11*a* disposed in an axial middle section; a shaping channel 11*b* disposed on each axial sides of the RSPS 11*a*; a tapered region 11*c* disposed on both sides of the RSPS 11*a*; and wherein the RSPS 11*a* has a cylindrical surface formed along the inner circumferential surface of the outer forming roll, in parallel to the axial direction of the stock material 1.

Figure 11:
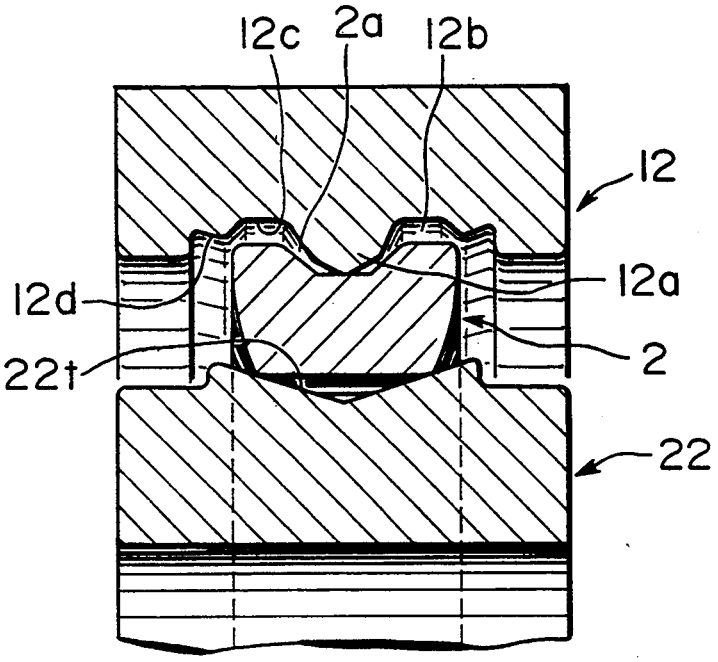
FIG. 11 shows a cross sectional view of the forming rolls used in the intermediate fabrication stage of the third embodiment.

As shown in FIG. 11, the outer intermediate shaping roll 12 comprises: a RSPS 12*a*; a shaping channel 12*b* disposed on each axial side of the RSPS 12*a*; wherein the RSPS 12*a* is formed as a two step mound section, and the shaping channel 12*b* is provided with a transition shaping section 12*d*.

Figure 12:
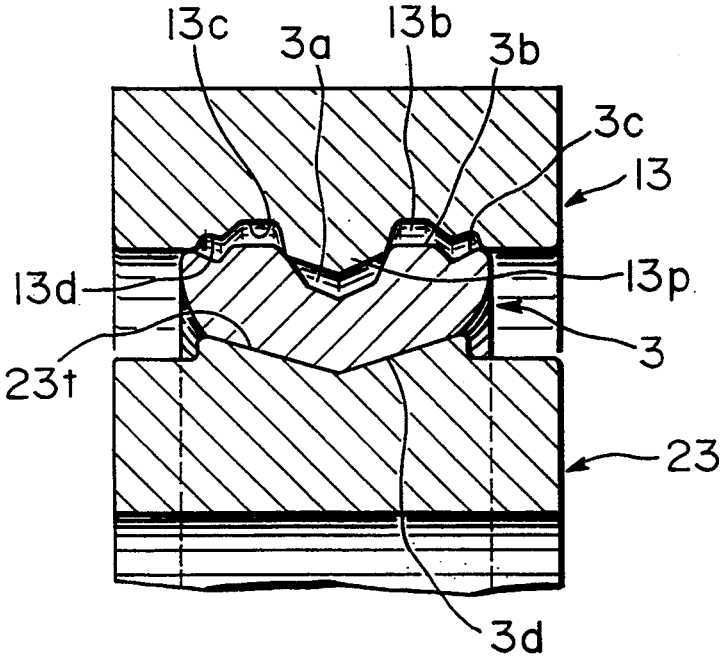
FIG. 12 shows a cross sectional view of the forming rolls used in the final fabrication stage of the third embodiment.

As shown in FIG. 12, the outer finish shaping roll 13 comprises: a RSPS 13*p* disposed in an axial middle section; a shaping channel 13*b* disposed on each axial side of the RSPS 13*p*; an outer forming section 13*c*; and a transition section 13*d*, and wherein the width of the RSPS 13*p* of the outer finish shaping roll 13 is larger than the RSPS 12*a* of the outer intermediate shaping rolls 12.

As shown in FIG. 10, the inner rough forming roll 21 is provided with a flat bottomed retaining section 21*a*.

As shown in FIG. 11, the inner intermediate roll 22 is provided with an axially symmetrical taper forming section 22*t* which is formed centrally and is depressed towards the center.

As shown in FIG. 12, the inner finish forming roll 23 is also provided with an axially symmetrical taper forming section 23*t* which is formed centrally and is depressed towards the center. This finish forming roll 23 is interchangeable with the intermediate forming roll 22, in other words, by maintaining the same profile of the tapered sections, a roll can be shared between the two stages.

Initial Fabrication Stage

In the initial fabrication stage, forming operation is carried out, as shown in FIG. 10, by disposing a stock material 1 between the outer rough shaping roll 11 and the inner rough forming roll 21, as shown in FIG. 10.

For example, in the initial fabrication stage, roll forming steps are repeated from fifty to five hundred times, preferably around three hundred times, to produce an initial ring body stock 2, shown in FIG. 11.

As shown in FIG. 10, while engaging the inner-surface of the stock material 1 with the retaining section of 21*a* of the inner rough forming roll 21, the outer peripheral surface of the stock material 1 is forced against the RSPS 11*a* of the outer rough shaping roll 11 to form an initial RSDR 2*a* shown by the dotted line in FIG. 10.

In this case, because the shifting of the stock material 1 in the axial direction is prevented by the engaging action the retaining section 21*a*, the RSDR 2*a* is formed at the specific location, i.e. the central region of the stock material 1 in FIG. 10.

As the formation of the RSDR 2*a* proceeds, the regions of contact under high pressures are deformed, and because the retaining section 21*a* is flat, the material flow takes place primarily in the direction perpendicular to the contact surface between the RSPS 11*a* of the outer rough shaping roll 11 and the stock material 1.

Further, since there is a gap between the forming rolls 11, 21, the stock material is allowed to flow in the axial direction as the roll forming process is continued, thus gradually increasing the axial dimensions and the inner diameter of the stock material while decreasing the effective cross sectional area of the stock material in the axial direction.

As outlined above, as the forming process of the RSDR 2*a* is continued, a large mass of the stock material becomes distributed in both axial directions, particularly in the vicinity of the outer peripheral surface of the initial ring body stock 2.

Intermediate Fabrication Stage

The intermediate fabrication stage is performed by holding the initial ring body stock 2 between the outer intermediate shaping roll 12 and the inner intermediate forming roll 22.

The roll forming operations are repeated, for example, from fifty to five hundred times, preferably about three hundred times to obtain an intermediate ring body stock 3 shown in FIG. 12.

As shown in FIG. 11, roll forming of the initial ring body stock 2 is carried out by pressing the ring body stock 2 between the outer intermediate shaping roll 12 and the inner intermediate forming roll 22 while supporting the inner peripheral surface of the ring body stock 2 with the taper forming section 22*t* of the inner intermediate forming roll 22 and engaging the initial RSDR 2*a* of the initial ring body stock 2 with the RSPS 12*a* of the outer intermediate shaping roll 12. Deformations occur at the regions of the ring body stock 2 under high contact pressure, such as between the RSPS 12*a* and the initial RSDR 2*a* on the one hand and between the taper forming section 22*t* and the inner peripheral surface of the ring body stock 2. The result is a formation of an intermediate ring-shaped body 2 showing a curved cross sectional shape.

Because the deformation processing is carried out by engaging the RSDR 2*a* with the RSPS 12*a*, the shifting of the intermediate ring body stock 2 in the axial direction is prevented, and the formation of the tapered region of the ring body stock 2 in contact with the taper forming section 22*t* of the finish forming roll 23 can take place without any axial shifting, thus allowing the stock material to be distributed evenly and smoothly in the axial direction.

The gap G between the outer intermediate shaping roll 12 and the inner intermediate forming roll 22 is maintained also during the intermediate fabrication stage. Therefore, the result of enlarging the initial RSDR 2*a* of the initial ring body stock 2 by the pressing action of the RSPS 12*a* of the outer initial shaping roll 12 is the formation of the intermediate RSDR 3*a* of the intermediate ring body stock 3, shown in FIG. 12, brought about by the radial compression of the stock material leading to the flow of the stock material in the axial direction.

In the intermediate fabrication stage, the intermediate RSDR 3*a* is formed on the outer peripheral surface of the ring body stock 2 by the action of the RSPS 12*a*; the thick shape change region 3*b*, 3*c* on the outer peripheral surface of the ring body stock 2 are formed by the action of the outer peripheral surface forming section 12*c* and the transition shaping section 12*d*; and the taper forming surface 3*d* is formed on the inner peripheral surface of the ring body stock 2 by the taper forming section 22*t* of the inner intermediate forming roll 22.

Therefore, as the forming process is continued, there is a gradual flow of the stock material from the inner peripheral surface to the outer peripheral surface and from the central region to the outer axial regions of the ring body stock 2.

During the fabrication of the outer peripheral surface of the ring body stock 2 in the intermediate fabrication stage, the RSPS 12*a* is continuously engaged with the RSDR 2*a* of the stock material, and together with the compression action of the ring body stock 2 by the outer peripheral surface forming section 12*b*, the overall result is the deepening of the initial RSDR 2*a* in the radial direction and the widening thereof in the axial direction, thus achieving distribution of the stock material evenly on both sides of the initial RSDR 2 in the axial direction.

In the meantime, on the inner peripheral surface side of the ring body stock 2, the taper region 3*d* of the ring body stock 2 is being formed by the taper forming section 22*t* of the inner intermediate forming roll 22, but the degree of deformation of the inner region of the ring body stock 2 is somewhat restricted by the taper forming section 22*t*, and the result is a tendency for a relatively greater transfer of the stock material in the outer peripheral surface region of the ring body stock 2.

Final Fabrication Stage

In the final fabrication stage, roll forming is carried out by placing the intermediate ring body stock 3 between the outer finish shaping roll 13 and the inner finish forming roll 23 as shown in FIG. 12.

The roll forming operations are repeated, for example, from fifty to five hundred times, preferably about three hundred times to obtain an intermediate ring body stock 3 shown in FIG. 12.

In this stage of fabrication also, the axial shifting of the ring body stock 3 is prevented and the dimensional precision is improved by engaging the intermediate RSDR 3*a* of the ring body stock 3 with the RSPS 13*p* of the outer finish shaping roll 13; and by engaging both tapered surface regions of the ring body stock 3 with the taper forming section 23*t* of the inner finish forming roll 23.

The forming of the ring body stock 3 during the final fabrication stage takes place primarily in the outer peripheral regions of the ring body stock 3 because the inner rolls 22, 23 are shared between the two forming stages, and the taper forming sections 22*t*, 23*t* of the inner rolls 22, 23 are the same shape as shown by FIGS. 11 and 12, respectively, for the intermediate fabrication and the final fabrication stages.

The RSPS 13*p* of the outer finish shaping roll 13 carries out the widening of the intermediate RSDR 3*a* of the intermediate ring body stock 3 in the axial direction to produce the final RSDR 4*a*; and the outer peripheral surface forming section 13*c* forms the shape change region 4*c* and the shape change section 4*d* which extends in the axial direction into the region 4*c*.

The deformation in the final fabrication stage is continued until the specified shape and dimensions, shown in FIG. 14, of the final ring body stock 4 are obtained. The gap G between the forming rolls 13 and 23 is maintained as shown in FIG. 13, so as to permit the material under radial compressive deformation to flow in the axial direction.

It is an effective control technique to periodically stop the deformation processing during the final fabrication stage to check the dimensions of the ring body (especially the inner diameter), and stop the operation when a specific dimension is achieved. More specifically, the dimensions of the various parts of the fabricated final ring body stock 4 are controlled, being aware that the next step will be machining to remove material, so that the dimension of one of the following is close to the final dimension, i.e. the inner radius to be slightly smaller; the outer radius to be slightly larger; and the axial dimension to be slightly larger than that of the final ring body stock 4.

Figure 13:
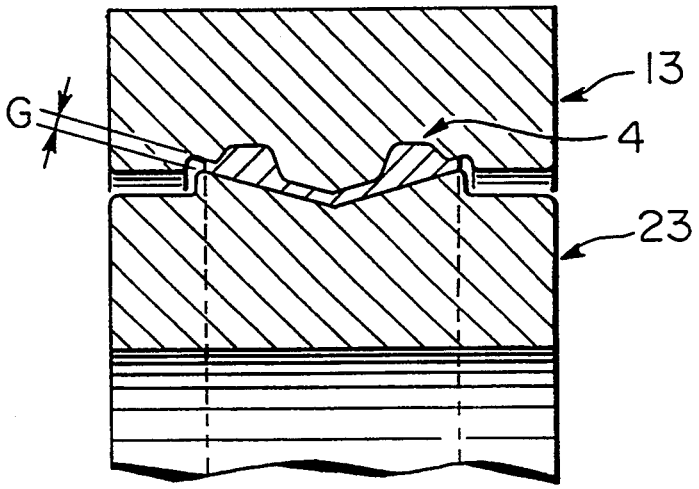
FIG. 13 shows a cross sectional view of the ring body in between a pair of forming rolls after the step shown in FIG. 12.

As shown in the examples of FIGS. 11 to 13, there is very little new deformation in the inner peripheral surface regions of the ring body during the final fabrication stage, therefore, the material necessary to produce the shape change sections 4*b*, 4*c* by the compressive action in the radial direction is supplied smoothly by the material flowing in the axial direction resulting from the thinning compressive action on the final RSDR 4*a*.

Machining Fabrication Stage

In FIG. 14, the excess materials is represented by the difference between a solid line and a dotted line, and is removed by suitable means such as machining and grinding. The final ring body stock 4 shaped by a series of forming steps to the shape shown by the solid line in FIG. 14, is represented by the solid line, and the dotted line represents the completed ring body 5. The excess material represented by the difference between the two lines is removed by machining fabrication.

The completed ring body 5 can be produced by either parting the final ring body stock 4 at the line X-Y and machining the individual part, or by separating the final ring body stock 4 at the time of machining or grinding.

In general, the ring body sizes are chosen so as to minimize the excess material to be machined off, however, to increase machining precision and/or production efficiency the material removed may range from 30–60% and preferably about 40%.

In summary, therefore, the criticality of the precise positioning of the initial RSDR 2*a* has now been demonstrated. In making two identical completed ring bodies 5 from an initial one ring body by a series of forming operations shown by FIGS. 9 to 14, the material flow and redistribution must be strictly controlled by the precise positioning of the initial ring-shaped depression section 2*a* in the initial fabrication stage.

Fourth Embodiment

FIG. 15 illustrates a fourth embodiment in which a series of forming operations are carried out to produce a ring body having a shape change region in the outer peripheral surface by a pair of forming rolls.

The complete processing involves the steps illustrated from (a) thorough to (g), and the outer rough shaping roll 11 and the inner rough forming roll 21 shown in (c) are used to perform the initial fabrication steps; and the outer finish shaping roll 13 and the inner finish forming roll 23 shown in (f) are used to perform the finish rolling steps. The finish shaping rolls 13, 23 are shared between the finishing and the intermediate roll forming stages.

In the forming steps of (a) through to (g), a gap G is maintained between the pairs of outer and inner rolls to enable the deformation of the ring body to take place in the axial direction in accordance with the examples illustrated in FIGS. 10 to 14.

As shown in FIG. 15 (g), a shape change region 4*b* of some thickness is left in the central region of the final ring body stock 4. The stock material in these regions is subjected to a large amount of axial deformation so as to produce shape change section 4*c* of a relatively thin cross sectional thickness.

Other Embodiments

The method of roll forming of the present invention can be applied to manufacturing of the ring shaped bodies of the following shapes.

(1) A ring-shaped metal body having a tapered inner peripheral surface whose axial end diameter is smaller than that in the axial central region.

(2) A ring-shaped metal body having a cylindrical inner peripheral surface.

(3) A ring-shaped metal body as in (1) or (2) above, and having shape change sections at axial ends or in an axial central region of the outer peripheral surface.

(4) A ring-shaped metal body having a plurality of shape change regions of large wall thickness or severe shape changes.

What is claimed is:

1. A method of fabricating surface shapes on a peripheral surface of a metallic ring body by roll forming a stock material having a ring-shape between a pair of nonconjugate rolls, the rolls consisting of a shaping roll and a forming roll, the axial cross sectional area of said stock material being roughly rectangular and larger than an axial cross sectional area of said metallic ring body, and the inner diameter of said stock material being smaller than an inner diameter of said metallic ring body, said method comprising the steps of:

preparing said pair of rolls so that a shape change section is provided on a radial peripheral surface of said shaping roll;

placing said stock material between said shaping roll and said forming roll, and pressing said shape change section against said stock material so as to form a shape change region on said peripheral surface of said stock material;

continuing to roll form while constantly maintaining a separation gap between said shaping roll and said forming roll to form surface shapes on said peripheral region of said stock material, the separation gap extending along an axial direction of the stock material and functioning to increase the axial dimension of said stock material until the exterior dimensions of said stock material approach the exterior dimensions of said metallic ring body;

forming an initial ring-shaped depressed region in a central axial region of said stock material; and engaging a ring-shaped protrusion section of said shaping roll with said initial ring-shaped depressed region to prevent shifting of said stock material in the axial direction during roll forming.

2. A method of producing a metallic ring body as claimed in claim 1, wherein said shaping roll is an inner roll.

3. A method of producing a metallic ring body as claimed in claim 1, wherein said shaping roll is an outer roll.

4. A method of producing a metallic ring body as claimed in claim 1, wherein roll forming is continued until one dimension selected from the group consisting of the inner diameter dimension, the outer diameter dimension and the axial dimension of the stock material attains a value close to a corresponding dimension of a completed metallic ring body.

5. A method of producing a metallic ring body as claimed in claim 1, wherein said method includes mechanical fabrication subsequent to roll forming.

6. A method of producing a metallic ring body as claimed in claim 1, wherein roll forming the shape change region on said stock material is performed while preventing deformation on a region of said stock material adjacent to said forming roll.

7. A method of producing a metallic ring body as claimed in claim 1, wherein said metallic ring body is divided in two parts at a plane perpendicular to the axis of said metallic ring body.

8. A method of producing a metallic ring body as claimed in claim 1, wherein said metallic ring body is symmetrical with respect to a plane perpendicular to the axis of said ring-shaped body.

9. A method of producing a metallic ring body as claimed in claim 1, wherein said initial ring-shaped depressed region is formed while restraining the plastic flow of said stock material in the axial direction.

10. A method of producing a metallic ring body as claimed in claim 1, wherein said method includes an intermediate fabrication stage, and subsequently roll forming is continued while permitting an axial flow of stock material adjacent to said shaping roll while preventing an axial flow of stock material adjacent to said forming roll.

11. A method of producing a metallic ring body as claimed in claim 10, wherein a forming roll used in said intermediate fabrication stage is used for subsequent fabrication stages.

12. A method of producing a metallic ring body as claimed in claim 1, wherein said stock material is prevented from shifting in the axial direction by an engagement of said shape change section formed on said shaping roll with an outer region of said stock material.

13. A method of producing a metallic ring body as claimed in claim 1, wherein said forming roll is provided with a tapered surface whose axial end diameters are larger than the diameter in a central region of said metallic ring body.

14. A method of producing a metallic ring body as claimed in claim 1, wherein said forming roll is provided with a tapered surface whose axial end diameters are smaller than the diameter in a central region of said metallic ring body.

15. A method of producing a metallic ring body as claimed in claim 1, wherein said method includes cold rolling.

16. A method of producing a metallic ring body as claimed in claim 1, wherein said metallic ring body comprises a hard material used in combustion chambers of gas turbines.

17. A method of producing a metallic ring body as claimed in claim 1, wherein said method includes an annealing step.

18. A method of producing a metallic ring body as claimed in claim 1, wherein said shape change section is provided near the axial ends of said shaping roll.

19. A method of producing a metallic ring body as claimed in claim 1, wherein said shape change section is provided near said initial ring-shaped depressed region of said stock material.

20. A method of producing a metallic ring body as claimed in one of claims 1 to 4, further comprising a step of diameter checking said stock material during a final fabrication stage.

* * * * *